US006645013B1

(12) United States Patent
Toyota et al.

(10) Patent No.: US 6,645,013 B1
(45) Date of Patent: Nov. 11, 2003

(54) ELECTRONIC SYSTEM AND CONNECTOR USED THEREIN

(75) Inventors: Kazuma Toyota, Yamato (JP); Kenichi Ishikawa, Hamura (JP)

(73) Assignees: Molex Japan Co. Ltd., Yamato (JP); Toshiba Corporation, Tokyo (JP)

( * ) Notice: Subject to any disclaimer, the term of this patent is extended or adjusted under 35 U.S.C. 154(b) by 137 days.

(21) Appl. No.: 09/607,209

(22) Filed: Jun. 30, 2000

(30) Foreign Application Priority Data

Jul. 5, 1999 (JP) ..... 11-190967

(51) Int. Cl.[7] ..... H01R 24/00
(52) U.S. Cl. ..... 439/660
(58) Field of Search ..... 439/79, 76, 660, 439/607, 609, 70, 947, 891, 653, 948, 371, 377, 638, 67, 74, 526; 174/52.4

(56) References Cited

U.S. PATENT DOCUMENTS

| | | | | | |
|---|---|---|---|---|---|
| 3,441,853 | A | * | 4/1969 | Bodine | 174/52.4 |
| 4,445,736 | A | * | 5/1984 | Hopkins | 174/52.4 |
| 4,698,025 | A | * | 10/1987 | Silbernagel et al. | 439/79 |
| 4,756,695 | A | * | 7/1988 | Lane et al. | 439/76 |
| 4,779,948 | A | * | 10/1988 | Wais et al. | 439/79 |
| 5,044,967 | A | * | 9/1991 | Takano | 439/79 |
| 5,500,788 | A | | 3/1996 | Longueville et al. | 361/800 |
| 5,647,765 | A | | 7/1997 | Haas et al. | 439/609 |
| 5,816,861 | A | * | 10/1998 | Cheng | 439/653 |
| 5,980,282 | A | | 11/1999 | Cheng | 439/157 |
| 5,984,696 | A | * | 11/1999 | Lee et al. | 439/79 |
| 6,162,099 | A | * | 12/2000 | Wu | 439/638 |

FOREIGN PATENT DOCUMENTS

| | | | |
|---|---|---|---|
| EP | 0 637 857 A2 | 2/1996 | H01R/23/70 |
| EP | 723 317 A2 | 7/1996 | H01R/23/70 |
| EP | 0 820 124 A2 | 1/1998 | H01R/23/70 |

OTHER PUBLICATIONS

Australian Patent Office Search Report, mailed by IPOS to Applicant on Mar. 1, 2002.

* cited by examiner

*Primary Examiner*—Jean F. Duverne
(74) *Attorney, Agent, or Firm*—Robert J. Zeitler

(57) ABSTRACT

The present invention provides a frame connector that includes a hollow portion for receiving a projecting block of a mating connector. Recess portions are provided on an inner circumferential surface of the hollow portion of the frame connector for receiving pin terminals of an electronic device, such as a hard disk drive. The present invention also contemplates a connector system wherein the frame connector is connected to a connector portion of an electronic device, such as a hard disk drive, having a plurality of pin terminals. The frame connector receives each pin terminal in a recess portion of the inner circumferential surface of the hollow portion and is mounted on the connector portion of the electronic device to protect the pin terminals from being bent. A mating, or base, connector is mounted to a substrate. The base connector includes a projecting block including base connector termninals. The projecting block of the base connector is inserted into the hollow portion of the frame connector resulting in the base connector terminals being brought into contact with corresponding pin terminals of the connector portion of the electronic device, thereby completing the electrical connection between the electronic device and the substrate.

17 Claims, 6 Drawing Sheets

ELECTRONIC SYSTEM AND CONNECTOR USED THEREIN

FIELD OF THE INVENTION

The present invention generally relates to the art of electronic systems and electrical connectors used therein and, particularly, to a simplified connector that connects an electronic device having pin terminals to a substrate.

BACKGROUND OF THE INVENTION

Japanese Patent Application Laid-Open No. Hei 6-168062 discloses a connector in which a module part is slidingly inserted into a guide housing, and a rear end of the module part is lifted by a pivot-like cam means provided in an end portion of the guide housing. Upon insertion, a contact of the other end portion is press-fit to a mother board of an electronic device fixed in the housing by rotating the entire module part, thereby performing the electric connection. However, with such an arrangement, it is difficult to easily connect the module part to the circuit board because a dedicated guide housing or a pivot-like cam means is required.

Alternatively, a simplified structure in which pin-like connector terminals are arranged at the end portion of the module part, recess-like connector terminals for receiving the pin-like connector terminals are arranged on the mother board of the corresponding electronic device, and the pin-like connector terminals are engaged with the recess-like connector terminals to perform the electric connection. Such an arrangement, however, is likely to result in the operator accidentally bending the pins upon making the electrical connection, thereby adversely affecting system performance.

SUMMARY OF THE INVENTION

In view of the foregoing problems inherent in the prior art, an object of the present invention is to provide an electronic system and a connector used therein in which the electric connection is performed positively and safely with a simple structure.

To accomplish the above-mentioned objective, the present invention provides for a frame connector. One embodiment of the frame connector includes a hollow portion for receiving a projecting block of a mating connector. Recess portions are provided on an inner circumferential surface of the hollow portion of the frame connector for receiving pin terminals of an electronic device, such as a hard disk drive.

The present invention also contemplates that ribs may be formed between the respective recess portions provided on the inner circumferential surface of the hollow portion of the frame connector.

The present invention also contemplates that the frame connector may have one or more guiding surfaces for guiding a mating connector into engagement with the frame connector. Corresponding guiding surfaces may also be located on the mating connector to ease the insertion of the mating connector into the hollow portion of the frame connector.

The present invention also contemplates a connector system wherein the frame connector is connected to a connector portion of an electronic device, such as a hard disk drive, having a plurality of pin terminals. The frame connector receives each pin terminal in the recess portion of the inner circumferential surface of the hollow portion and is mounted on the connector portion of the electronic device to protect the pin terminals from being bent during mating with a mating connector or otherwise coming into contact with an operator during the mating operation. A mating, or base, connector, is mounted to a substrate. The base connector includes a projecting block including base connector terminals. The projecting block of the base connector is inserted into the hollow portion of the frame connector resulting in the base connector terminals being brought into contact with corresponding pin terminals of the connector portion of the electronic device, thereby completing the electrical connection between the electronic device and the substrate.

Other objects, features and advantages of the invention will be apparent from the following detailed description taken in connection with the accompanying drawings.

BRIEF DESCRIPTION OF THE DRAWING

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
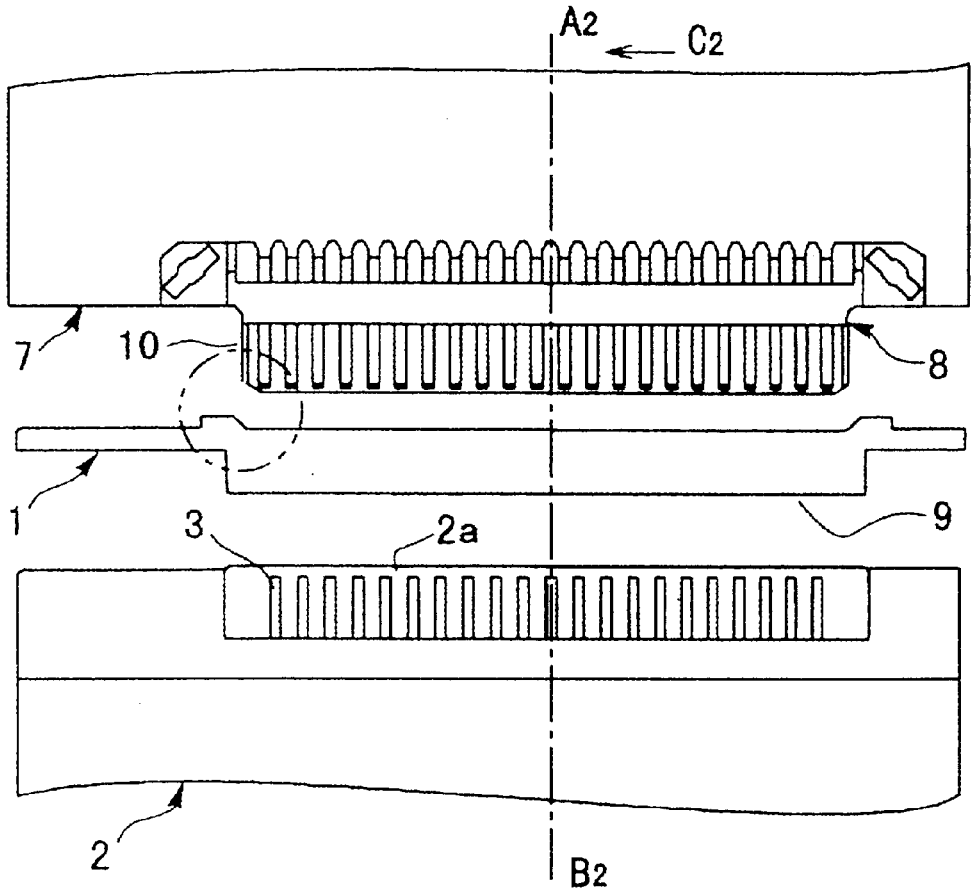
FIG. 1 is a top view of one embodiment of an electronic system embodying the concepts of the invention.

Referring to the drawings in greater detail, and first to FIG. 1, one embodiment of an electronic, or computer, system incorporating the electrical connector of the present invention will be described. FIG. 1 is a top view of an electronic system including, inter alia, an electronic device 2, such as a hard disk drive, and a substrate 7, such as a printed circuit board, to be connected to the electronic device.

Figure 3:
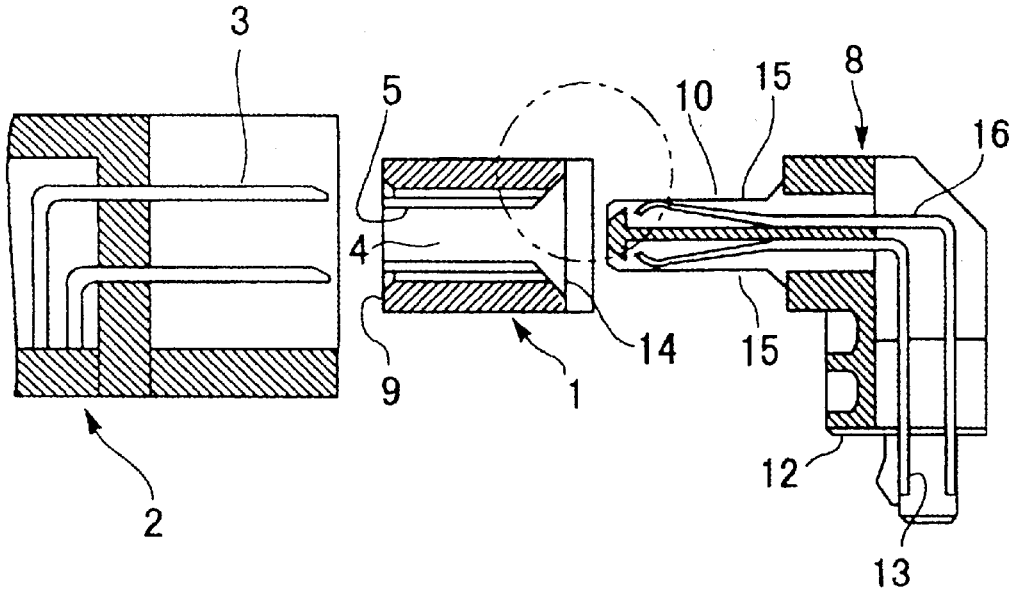
FIG. 3 is a cross-sectional view taken along line A2–B2 of FIG. 1.

As shown in FIGS. 1 and 3, the electronic system includes of a frame connector 1 mounted on the pin terminals 3 of a connector portion 2*a* of the electronic device 2. The system also includes a base connector 8 mounted to the substrate. The base connector 8 may be fixed to the substrate 7 by soldering or any other known method of mounting a connector to a substrate.

As illustrated in FIGS. 3, 5, 7, 8 and 9, the frame connector 1 has a plurality of recess portions 11 for receiving the pin terminals 3 of the connector portion 2*a* of the electronic device 2. The recess portions 11 are formed on an inner circumferential surface 5 of the frame connector 1, with the open portions of the recess portions 11 surrounding a hollow portion 4 of the frame connector 1. Ribs 5*a* are shown formed between the recess portions 11 (FIG. 3).

The base connector 8, shown in FIGS. 3, 6, 10 and 11, includes a projecting block 10 to be inserted into the hollow portion 4 of the frame connector 1. The base connector terminals 16 of the base connector 8 are brought into contact with the pin terminals 3 of the connector portion 2*a* of the electronic device by being received in the recess portions 11 of the frame connector 1 upon the insertion of the projecting block 10 into the hollow portion 4 of the frame connector 1. The base connector terminals 16 have a soldering portion 13 on one end thereof which make contact with the substrate contact surface 12.

The frame connector 1 is mounted on the pin terminals 3 of the connector portion 2*a* of the electronic device 2. The frame connector 1 is mounted on the electronic device 2 having pin terminals 3 in a direction from a pin receiving surface 9 (as shown in FIG. 1), and is covered and fixed by a cover (not shown) to be mounted on the electronic device 2. Accordingly, the pin terminals 3 of the connector portion 2*a* of the electronic device 2 are received and protected by the recess portions 11 located on the inner circumferential surface 5 of the frame connector 1.

The base connector 8 is soldered to the substrate 7 at the soldering portion 13 of the base connector terminals 16. In the embodiment shown, since the projecting block 10 of the base connector 8 is inserted into an opening portion 14 of the frame connector, and the base connector terminals 16 on the outer circumferential surface 15 of the projecting block 10 are brought into contact with the pin terminals 3, there is no concern that the pin terminals 3 of the connector portion 2*a* of the electronic device 2 would be directly touched by a worker connecting the electronic device 2 to the substrate 7. The base connector 8 may also be engaged under the condition that it is guided by the hollow portion 4 of the frame connector 1, thereby performing electric connection positively and safely.

Figure 2:
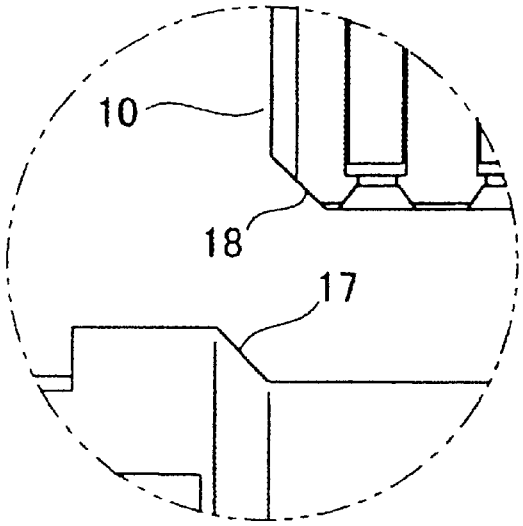
FIG. 2 is an enlarged view of a guide slant surface in a horizontal direction illustrated in FIG. 1.
Figure 4:
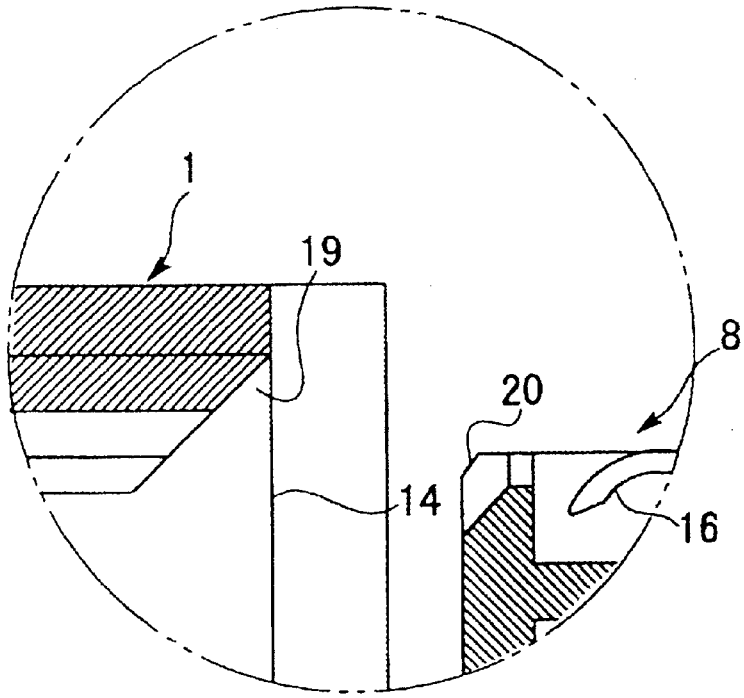
FIG. 4 is an enlarged view of a guide slant surface in a vertical direction illustrated in FIG. 3.
Figure 5:
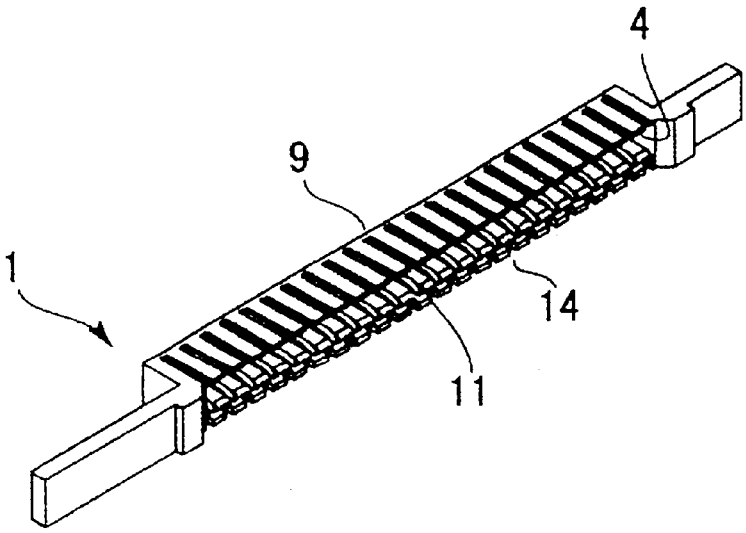
FIG. 5 is a perspective view of a frame connector.
Figure 6:
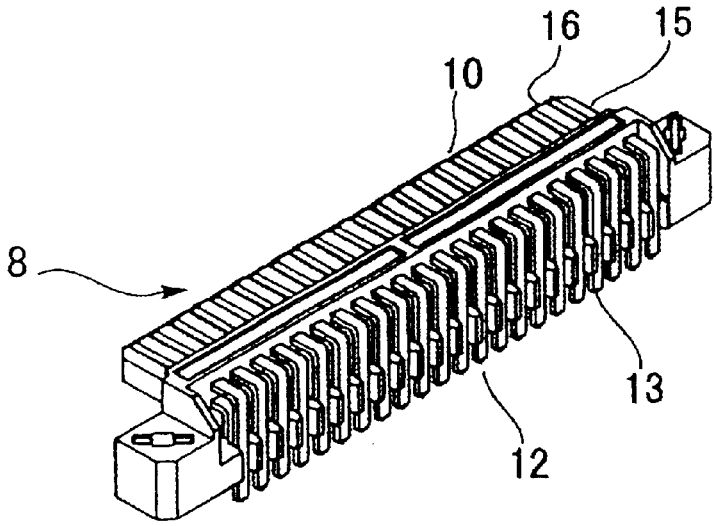
FIG. 6 is a perspective view of a base connector.
Figure 7:
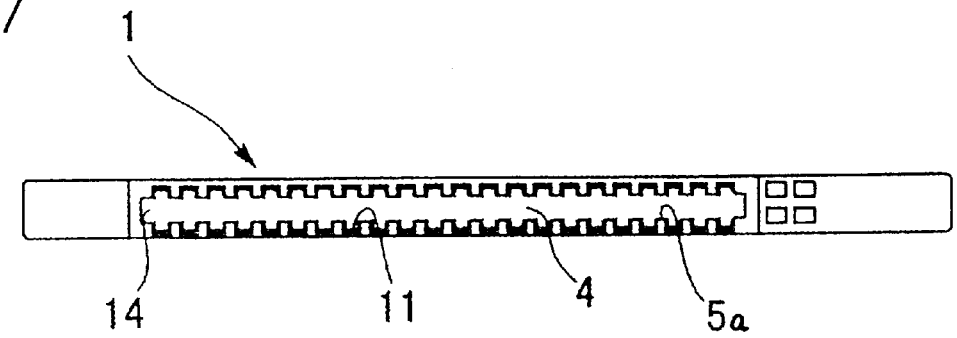
FIG. 7 is a front view on the pin insertion side of the frame connector.
Figure 8:
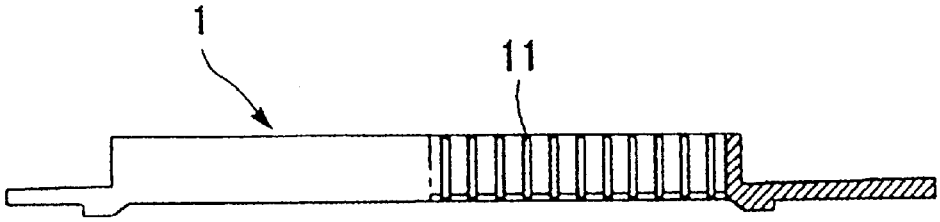
FIG. 8 is a top view of the frame connector.
Figure 9:
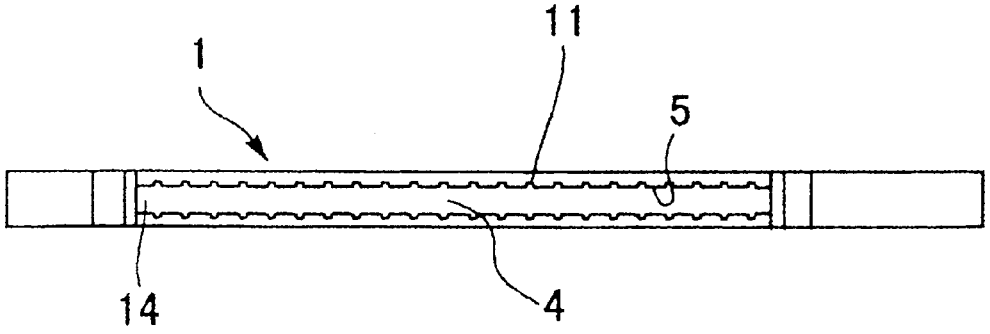
FIG. 9 is a front view on the projecting block insertion side of the frame connector.
Figure 10:
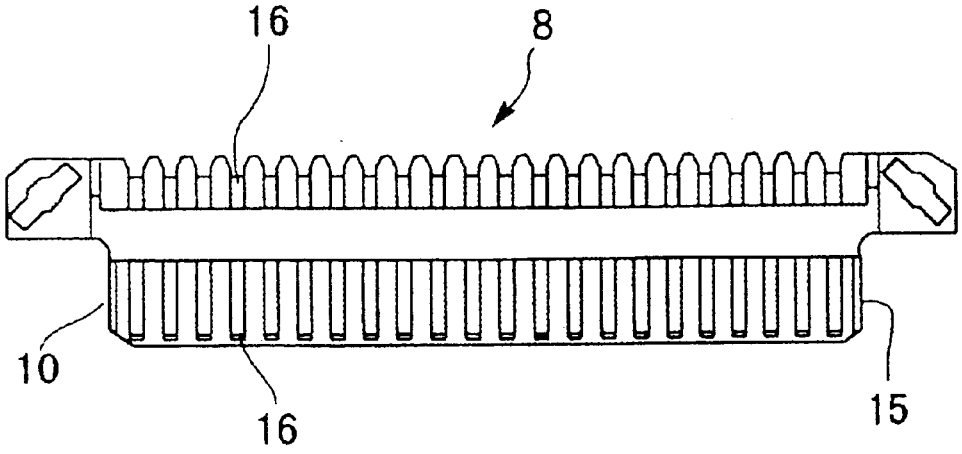
FIG. 10 is a top view of the base connector.
Figure 11:
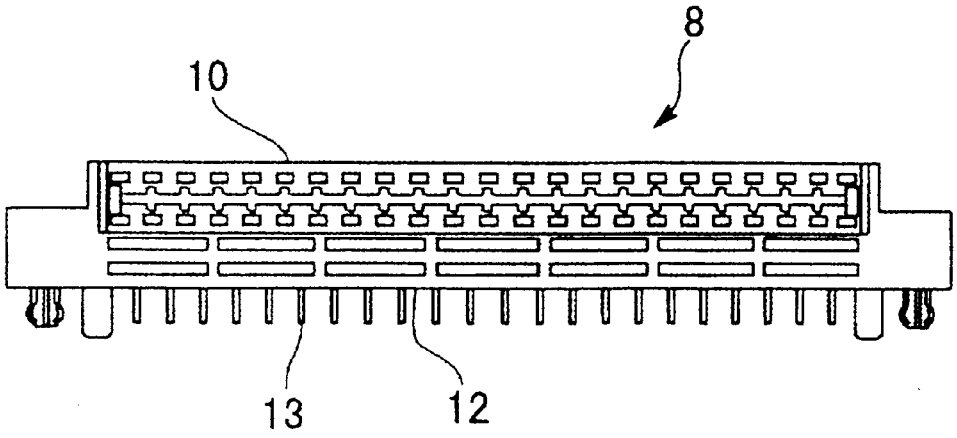
FIG. 11 is a front view on the projecting block side of the base connector.

Furthermore, as shown in FIG. 2, a guide slant surface 17 of the frame connector 1 may be provided at an opening end of the frame connector 1 and a guide slant surface 18 may be provided at a tip end portion of the projecting block 10 of the base connector 8. In the embodiments of the frame connector 1 and base connector 8 shown in FIG. 2, the slant surfaces 17 and 18 are in a horizontal direction relative to a longitudinal direction of the respective connectors. As illustrated in FIG. 4, a guide slant surface 19 in a vertical direction relative to the longitudinal direction of the frame connector 1 may also be provided at an opening end of the frame connector 1 and a guide slant surface 20 in a vertical direction relative to the longitudinal direction of the base connector 8 may be provided at a tip end portion of the projecting block 10. These guide slant surfaces can be included on the base connector 8 and the frame connector 1 to reduce the amount of force necessary to mate the frame connector 1 with the base connector 8.

Turning to FIG. 2, when the tip end portion of the projecting block 10 of the base connector 8 is brought into contact with the guide slant surface 17 of the opening end of the hollow portion 4 of the frame connector 1, the base connector 8 is guided to the connection position by the slant of the slant surface. In the same manner, in the case that the opening portion 14 of the frame connector 1 is brought into contact with the guide slant surface 18 of the tip end portion of the projecting block 10 of the base connector 8, the frame connector 1 is guided to the connection position by the slant of the slant surface.

The guide slant surfaces in the horizontal direction with reference to FIG. 2 have been described above. Likewise, the guide slant surfaces 19 and 20 in the vertical direction of FIG. 4 function in a like manner.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A frame connector comprising:

a top wall, a bottom wall and opposing side walls;

a hollow portion defined by the top, bottom and side walls, the hollow portion extending from a first end to a second end of the frame connector and having an inner surface;

at least one recess portion in the inner surface; and the inner surface having at least one guide slant surface at an opening end of the hollow portion, said frame connector being formed without the usage of conductive materials.

2. The frame connector of claim 1 wherein the guide slant surface is in a horizontal direction to a longitudinal direction of the frame connector.

3. The frame connector of claim 1 wherein the guide slant surface is in a vertical direction to a longitudinal direction of the frame connector.

4. The frame connector of claim 1 wherein the guide slant surface is in a horizontal direction and a vertical direction to a longitudinal direction of the frame connector.

5. The frame connector of claim 1 wherein ribs are formed between adjacent recess portions.

6. A connector system, comprising:

a frame connector being formed without the usage of conductive materials, the frame connector having a top wall, a bottom wall and opposing side walls, the frame connector including a hollow portion defined by the top, bottom and side walls and extending from a first end to a second end of the frame connector, the hollow portion having an inner surface, and at least one recess portion in the inner surface; and a base connector, the base connector including a projecting block for engaging the hollow portion of the frame connector.

7. The connector system of claim 6, wherein the base connector includes at least one terminal on an outer surface of the projecting block.

8. The connector system of claim 6 wherein ribs are formed between adjacent recess portions.

9. The connector system of claim 6 wherein an opening end of the hollow portion of the frame connector has at least one guide slant surface.

10. The connector system of claim 6 wherein a tip end portion of the projecting block includes at least one guide slant surface.

11. A computer system for connecting an electronic device having a connector portion with at least one pin terminal to a substrate, the computer system comprising:

a frame connector, the frame connector having a top wall, a bottom wall and opposing side walls, the frame connector including a hollow portion defined by the top, bottom and side walls and extending from a first end to a second end of the frame connector, the hollow portion having an inner surface, and at least one recess portion in the inner surface, the recess portions corresponding to an arrangement of the pin terminals of the connector portion of the electronic device and the recess portions receiving the pin terminals of the connector portion of the electronic device;

a base connector, the base connector including a projecting block for engaging the hollow portion of the frame connector and terminals mounted on an outer surface of the projecting block, the terminals coming into contact with corresponding pin terminals upon insertion of the projecting block into the hollow portion of the frame connector;

wherein the base connector is mounted on the substrate.

12. The computer system of claim 11 wherein ribs are formed between adjacent recess portions.

13. The computer system of claim 11 wherein an opening end of the hollow portion of the frame connector has at least one guide slant surface.

14. The computer system of claim 11 wherein a tip end portion of the projecting block includes at least one guide slant surface.

15. The computer system of claim 11 wherein the electronic device is a hard disk drive.

16. The computer system of claim 11 wherein the substrate is a printed circuit board mounted in the computer.

17. The computer system of claim 16 wherein the electronic device is inserted into the computer thereby connecting the electronic device to the printed circuit board.

* * * * *